United States Patent [19]

Mettler

[11] Patent Number: 4,614,211

[45] Date of Patent: Sep. 30, 1986

[54] DOBBY

[75] Inventor: Franz Mettler, Richterswil, Switzerland

[73] Assignee: Staeubli Ltd., Horgen-Zuerich, Switzerland

[21] Appl. No.: 620,869

[22] Filed: Jun. 15, 1984

[30] Foreign Application Priority Data

Jun. 16, 1983 [CH] Switzerland ..... 3297/83

[51] Int. Cl.[4] ..... D03C 1/00

[52] U.S. Cl. ..... 139/76; 139/66 R

[58] Field of Search ..... 139/76, 66 R

[56] References Cited

U.S. PATENT DOCUMENTS

| | | | |
|---|---|---|---|
| 3,468,347 | 9/1969 | Fumat | 139/66 R |
| 3,724,511 | 4/1973 | Kleiner | 139/66 R |
| 3,726,323 | 4/1973 | Kleiner | 139/66 R |
| 3,730,232 | 5/1973 | Kleiner | 139/66 R |
| 3,804,128 | 4/1974 | Amigues | 139/66 R |
| 4,367,770 | 1/1983 | Schwarz | 139/66 R |
| 4,552,184 | 11/1985 | Kleiner | 139/76 |

FOREIGN PATENT DOCUMENTS

| | | | |
|---|---|---|---|
| 2036643 | 12/1971 | Fed. Rep. of Germany | 139/66 R |
| 2841278 | 11/1979 | Fed. Rep. of Germany . | |
| 3001310 | 6/1981 | Fed. Rep. of Germany . | |

*Primary Examiner*—Henry S. Jaudon
*Assistant Examiner*—Joseph S. Machuga
*Attorney, Agent, or Firm*—Flynn, Thiel, Boutell & Tanis

[57] ABSTRACT

A rotary switch is provided in a dobby with a rotation drive and has for controlling the coupling part an annular collar. During rotation of the drive shaft, the coupling part is guided actively by the rotary switch, the position of which during this time is releasably secured by a lock. For this purpose, a differential lever is arranged on the dobby, the position of which varies based on feedback through a rocking lever and a rail which indicates the position of the heddle frame. The reading of a point on the pattern card results automatically in the correct engaging or disengaging movement of the coupling part, independent of its position.

8 Claims, 8 Drawing Figures

DOBBY

FIELD OF THE INVENTION

This invention relates to a dobby and, more particularly, to a dobby with a rotation drive which has a coupling part selectively engageable with grooves in a drive shaft or in an eccentric member or connecting rod and has a control member which effects movement of the coupling part.

BACKGROUND OF THE INVENTION

Dobbies of the foregoin are disclosed in U.S. Pat. Nos. 3,724,511 and 3,730,231.

The radial engaging and disengaging movement of the coupling part in the eccentric ring, during a standstill of the drive shaft, is effected according to a pattern by a switching member which has a circular opening arranged approximately concentrically to the drive shaft. The circular opening has over its entire periphery a collar which projects beyond the rotary switching member and constantly engages a sliding groove in the coupling part. The switching member is thereby supported tiltably in the plane of its circular opening, and its movement during the control operation of the engaging and disengaging of the coupling part is automatically effected by the control system of the dobby during the standstill of the drive shaft. During rotation of the drive shaft, the switching member is freely movable, and is moved by the coupling part in correspondence with the movement of the coupling part as the coupling part pivots 180° with the drive shaft due to the cooperating sliding groove and the collar, which assures that the switching member can properly effect its control function at any time with respect to the coupling part. In this embodiment, the coupling part lies, during its 180° swinging movement, in a groove in the eccentric ring and is taken along by the drive shaft. To avoid disengagement of the coupling part from the groove of the drive shaft, springs are arranged in the coupling part. In addition, the connecting rod has resilient, semicircular guide rails, against which the coupling part can rest.

In German Pat. No. 30 01 310, the coupling part is held by a pawl in its swinging movement.

German Offenlegungsschrift No. 2 256 863 (corresponds to U.S. Pat. No. 3,804,128) and German Auslegeschrift No. 2 841 278 both suggest replacing the aforementioned switching member having a circular opening with two rotary switching arms, at the ends of which are arranged groove stones which, during the duration of the control operation of the coupling part, engage grooves of the coupling part. During the rotary movement of the coupling part, these rotary switch arms are not operatively connected to the coupling part. This fact and the repeated moving of the groove stone into the groove of the coupling part at the beginning of each control operation presents an instability factor, which requires additional control and safety members. In particular, in the case of high speeds, an orderly control is no longer assured. In addition, it is difficult, due to the prescribed pitch, namely, the limited heddle-frame thickness in a weaving machine, to properly mount these additional control and safety members.

SUMMARY OF THE INVENTION

A purpose of the invention is thus to overcome these instabilities in the path of movement of the coupling part and to eliminate the additional, special, expensive and complicated guiding and holding elements for the coupling part while maintaining a secure control operation.

This is achieved with a dobby in which the switching member continuously controls and guides the coupling part at all times during the operation of the dobby.

An annular guide part on the switching member is always slidingly disposed in a groove in the coupling part and, in contrast to conventional arrangements, controls movement of the coupling part even during rotation of the shaft.

For this, the switching member is subject to a frictional control movement and a form-locking blocking during its guiding function, so that its annular guide part is in a concentric position with respect to the drive shaft. The known holding and guiding members can thus be omitted..Still, the danger exists that the control member, during a standstill of the coupling part in which it is aligned with a groove of the drive shaft or a stationary locking opening, is in an operating position. The locking opening is preferably provided on the machine frame or on the connecting rod in which the eccentric ring is rotatably supported.

BRIEF DESCRIPTION OF THE DRAWINGS

An exemplary embodiment of the invention is schematically illustrated in the drawings, in which certain known parts which are not inventively important, such as drives and controls for individual elements, have been omitted.

In the drawings.

DETAILED DESCRIPTION

Figure 6:
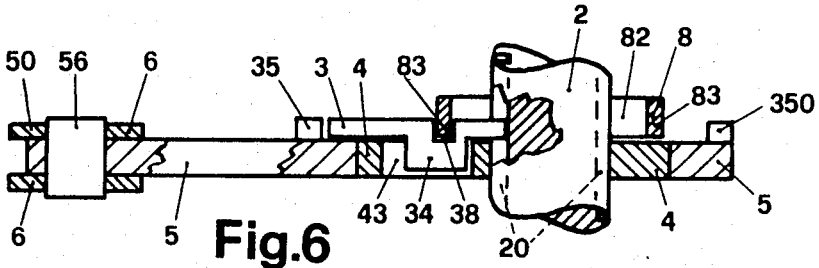
FIG. 6 is a sectional view taken along the line VI—VI of FIG. 2 and in an enlarged scale.
Figure 7:
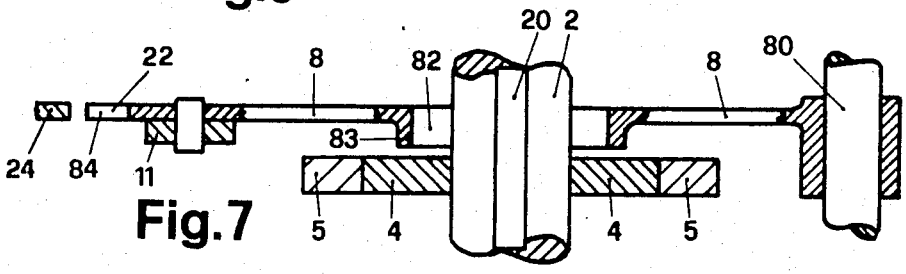
FIG. 7 is a sectional view taken along the line VII—VII of FIG. 2 and in an enlarged scale.

A main shaft or drive shaft 2 is supported rotatably in a dobby housing 1 and drives a rotation lifting unit, which is supported on the main shaft. A conventional drive mechanism, which is not illustrated, intermittently rotates the shaft with a short pause or locking hold which is repeated after each 180° of rotation. The coupling part or key 3, which is radially slidably supported with its shoulder 34 (FIG. 6) in a slot 43 of an eccentric member or eccentric plate 4, can be controlled during this locking hold. The eccentric plate 4 freely rotatably supports a connecting rod 5 and is itself supported freely rotatably on the drive shaft. A free end 50 of the connecting rod 5 is pivotally supported by a bolt 56 on a rocking lever 6, which is pivotally supported on a stationary shaft 60 on the housing. A connecting rod 7, which moves the heddle frame in a conventional manner through one or more intermediate levers which are not illustrated, is pivotally supported on the free end of the rocking lever 6. Thus, rotation of the eccentric member 4 in FIG. 1 effects movement of the connecting rod 5, lever 6 and rod 7, therbey effecting movement of the heddle frame. The heddle frame is in its lower-shed position when the connecting rod 7 is in the position illustrated in FIG. 1, which lower-shed position is reached when in the illustrated embodiment the coupling part 3 is on the side of the shaft 1 which faces the free end 50 of the connecting rod 5.

If, according to a pattern in a pattern card 19, no position change of the heddle frame is supposed to occur, the coupling part 3 is moved radially outwardly into the locking groove 35. The drive shaft 2 then rotates 180° without the coupling part 3 and thus without the eccentric plate 4.

The rotary switch or control lever 8, which is used to control the coupling part 3, is pivotally supported on a stationary shaft 80 and has a circular control opening 82 which is encircled by an annular control and guide portion of the lever 8 which has thereon an annular, axially projecting collar 83. The collar 83 slidably engages at all times a sliding groove 38 (FIG. 6) in the coupling part 3 and projects beyond the plane of the rotary switch 8. The free upper end of the rotary switch 8 has two prongs 84 and one end of a plate 11 is pivotally coupled thereto, and a differential lever 12 is pivotally connected between its ends (at 121) to the other end of the plate 11. One end of the differential lever 12 is connected by a rail 13 to the rocking lever 6 at 122, while the draw hook 14 is pivotally coupled to the other end of the lever 12, at 120. The draw hook 14 can be pulled rightwardly against the force of a return spring 81 by a back-and-forth swinging draw knife 15. By means of up-and-down movement of a rod 16, the reading operation of a reading needle 17 which hangs on the draw hook 14 is effected, which reading needle 17 slides in guideways 18 and thereby reads a nonperforated or perforated point on the pattern card 19, which is moved by the card cylinder 9 in a step-by-step manner, namely, pick by pick. Reference numeral 110 identifies a guide rake, in which the plate 11 is guided so that the differential lever 12 remains positioned in its path of movement.

The two prongs 84 on the rotary switch 8 effectively define at the free end of the rotary switch 8 three notches 21, 22 and 23, against the flanks of which a holding member or lock 24 rests in its locking position.

The locking movement of the lock 24 is now discussed in connection with FIG. 4. All of the locks 24 of the dobby are mounted on a common rod 25 and are moved up and down simultaneously. The rod 25 is supported at each end in a respective rocker arm 26, which is pivotally supported on a housing-fixed pin 27. A free lever arm 260 of the rocker arm 26 slidably engages a cam plate 28 provided on an axle 29 which is rotationally driven in a not-illustrated manner by the drive shaft of the dobby, contact between arm 260 and cam plate 28 being maintained by a tension spring 30.

The operation of the dobby will now be discussed in connection with FIGS. 1 to 5.

Figure 1:
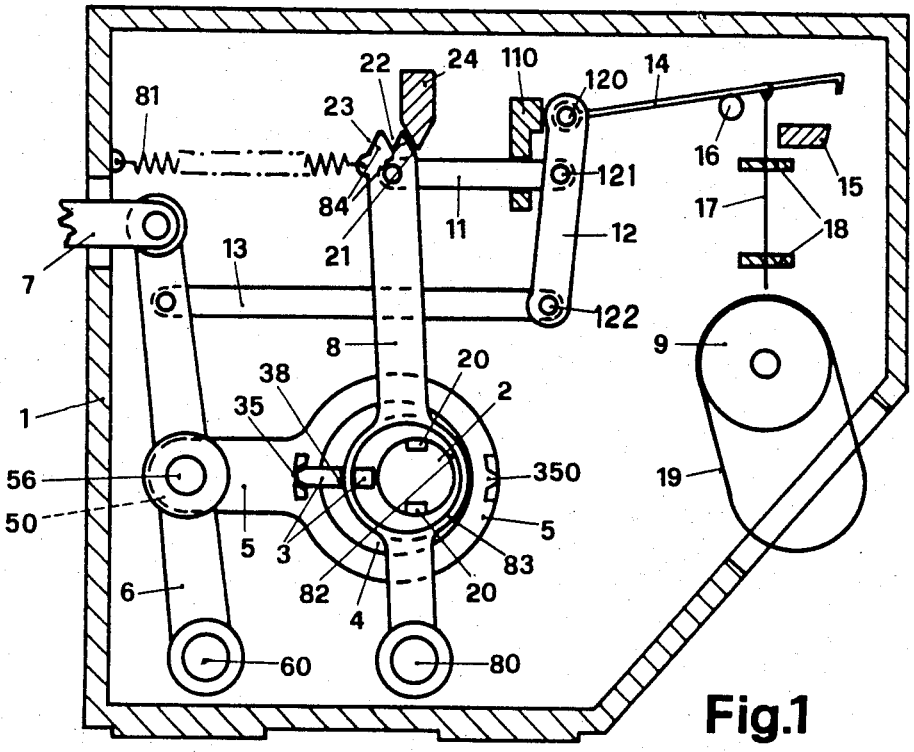
FIG. 1 is a sectional view of a dobby embodying the invention, and shows substantially one lifting unit which operates on the known rotation principle and controls a heddle frame, the dobby being depicted in the base position, namely, during rotation of the drive shaft but during standstill of the heddle frame, which is in the lower-shed position.

FIG. 1 illustrates the position of the dobby during a shaft rotation with no change of the heddle frame position. The drive shaft 2 will rotate 180° , and is shown during this rotation. Earlier, the reading needle 17, during its lowering onto the pattern card 19, engaged a nonperforated point and, since the draw hook 14 was held above the draw knife 15 and the lock 24 was lifted at that point in time, the free end of the rotary switch 8 was moved to the left by the urging of the spring 81. The cooperation of the collar 83 of the rotary switch and the sliding groove 38 in the coupling part 3 caused the coupling part to be moved to the left and into engagement with the locking opening 35. The lock 24 was then lowered into the notch 21 until flanks of the rotary switch notch 21 and lock 24 abutted (as illustrated in FIG. 1). The heddle frame, which had previously been moved into the lower-shed position by the rocking lever 6, remains in such position during the rotation of the drive shaft 2.

Simultaneous with the rotation of the drive shaft, the reading needle 17 is lifted by the rod 16 so that the card cylinder 9 can index the pattern card 19 to the position for the next pick, namely, one information point. With respect to the weaving machine, illustrated position (FIG. 1) corresponds to the point of operation at which the moving heddle frames are in the center-shed position.

Figure 2:
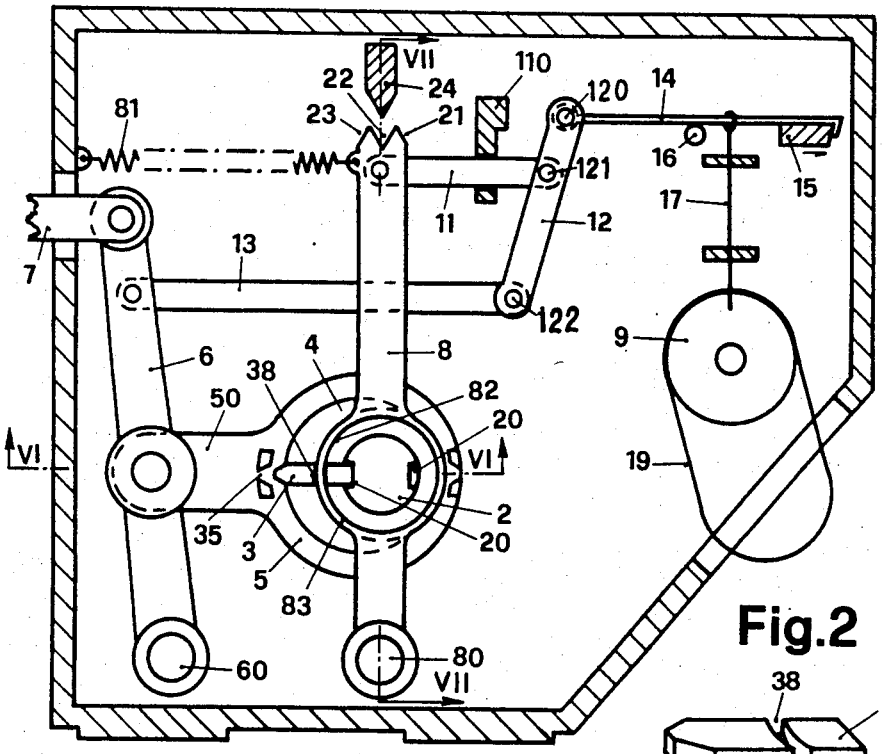
FIG. 2 is a sectional view similar to FIG. 1, but showing a position of operation in which the coupling part engages a groove of the drive shaft and the drive shaft is still standing still.
Figure 8:
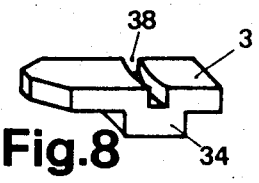
FIG. 8 is a perspective view of a coupling part which is a component of the apparatus of FIG. 1.

FIG. 2 illustrates the dobby in a standstill after the drive shaft 2 has rotated 90° from the situation according to FIG. 1, wherein one of the grooves 20 is aligned with the coupling part 3. The rod 16 is now lowered and, in the illustrated example, the reading needle 17 reads a hole, which causes the draw hook 14 to be lowered until its hook tip rests on the draw knife 15, which moves the draw hook rightwardly during its rightward movement. The upper end 120 of the differential lever 12 is thereby pivoted away from the guide rake 110 about the joint connection 122 on the rail 13, which cannot move longitudinally because of the standstill of the rocking lever 6. Since the lock 24 is lifted during the control operation of the reading needle 17, during the swinging of the differential lever 12 the rotary switch 8 is also swung by the plate 11 against the urging of the spring 81. The coupling part 3 is thus moved into the groove 20 by the collar 83 of the rotary switch 8 and at the same time is moved out of the locking groove 35. Then, after a slight rotation of the drive shaft 2, the cam 28 causes the lock 24 to be lowered into the center notch 22 of the switch 8, which causes the switch 8 to be locked in the center position in which the control opening 82 is concentric with respect to the drive shaft 2.

During the next 180° rotation of the drive shaft 2, its groove 20 takes along the coupling part 3, the shoulder 34 thereon, and the eccentric plate 4, which causes the connecting rod 5, which is supported on the plate 4, to be moved to the right. This movement effects a swinging of the rocking lever 6 and thus a pulling up of the heddle frame into its upper-shed position.

Figure 3:
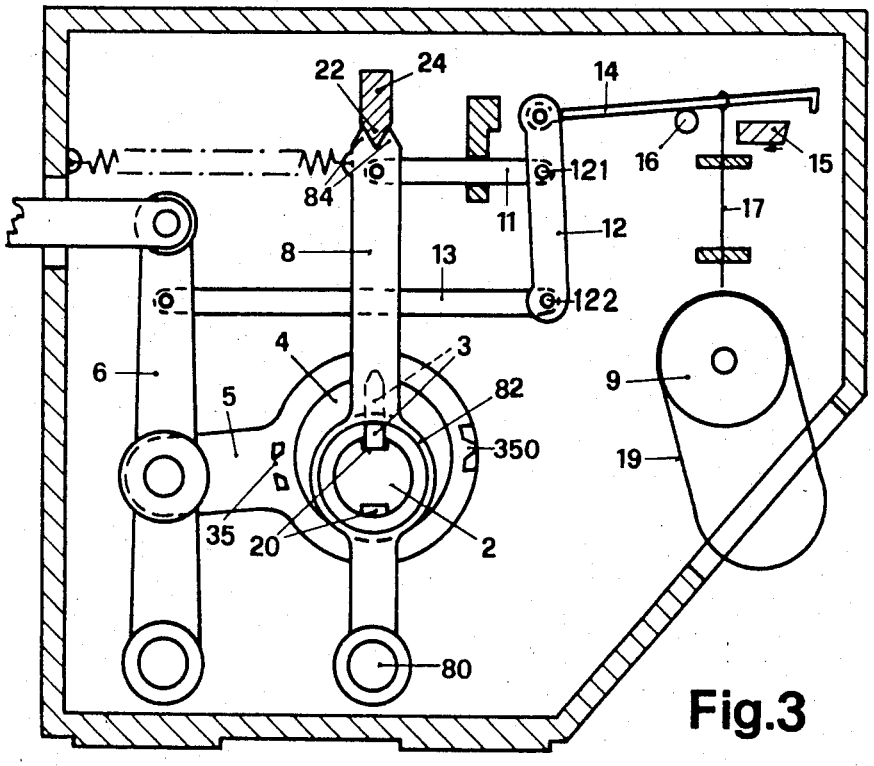
FIG. 3 is a sectional view similar to FIG. 1, but showing a position of operation during the rotation of the drive shaft as it carries along the coupling part and thus effects movement of the heddle frame.

FIG. 3 illustrates a position of the dobby which differs from FIG. 2 by a 90° rotation of the drive shaft 2.

The not-illustrated heddle frame is in its center-shed position. Due to the swinging movement of the rocking lever 6, the differential lever 12 is pivoted by the rail 13 and the joint connection 122 about the pin at 121, which is presently stationary because of the lowered lock 24. This is made possible by the fact that the draw knife 15 has, in the meantime, again moved to its rest position and the draw hook 14 and the reading needle 17 have been lifted up by the rod 16, so that the pattern card 19 can be indexed to the next position by the card cylinder 9.

Figure 4:
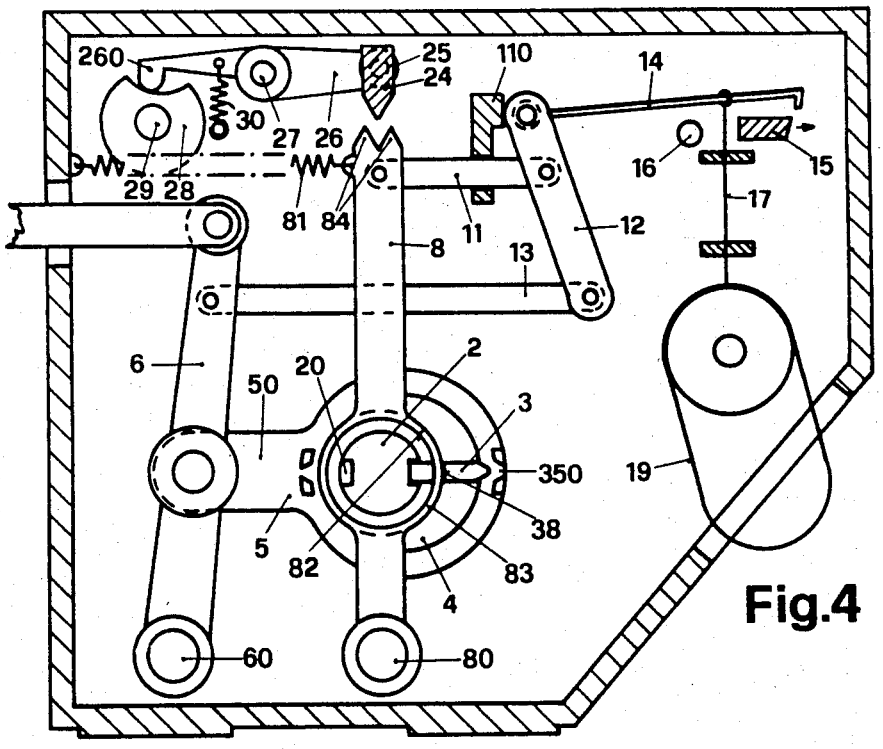
FIG. 4 is a sectional view similar to FIG. 1, but showing a position of operation after a 180° rotation of the drive shaft has ended, wherein the coupling part is ready to be controlled for the next movement of the heddle frame.

During its entire 180° rotary movement, from the position shown in FIG. 2 through the position shown in FIG. 3 to the position shown in FIG. 4, the coupling part 3 is guided by the rotary switch 8 and in particular by the collar 83 thereon which is arranged around the control opening 82 and, due to the concentric position of the control opening 82 with respect to the drive shaft 2, provides an ideal guide. Practice has shown that wear of the sliding groove and collar wall are negligible with respect to the friction of the collar 83 in the sliding groove 38 of the coupling part which results during this guiding, since the coupling part 3 has no tendency during its pivotal movement to move out of the groove 20 of the drive shaft 2. The forced, constant guiding of the coupling part is important, since during its swinging movement centrifugal forces can act onto it and during this time a new reading of the next pick occurs.

FIG. 4 illustrates a control position for the coupling part after the end of the 180° rotation of the drive shaft 2, wherein the not-illustrated heddle frame is, for the pick insertion, in its upper-shed position. If the heddle frame is, based on the next pick insertion, to be moved again to its lower-shed position, then the reading needle 17 reads as illustrated a nonperforated point on the pattern card 19. The draw hook 14 remains above the draw knife 15 and is not taken along by the rightward movement of knife 15. The differential lever 12 has its upper end 120 resting on the guide rake 110. Under the action of the spring 81, the rotary switch 8 remains, even after the release of the lock 24, in its position, due to the fact that the differential lever 12 is held by the guide rake 110 and by the rocking lever 6 and rail 13 in the illustrated position (FIG. 4). The position of the coupling part 3 with respect to the drive shaft 2 remains unchanged. The position change of the heddle frame during the rotation phase of the drive shaft 2 can then take place normally. The eccentric plate 4 moves the connecting rod 5 to the left and the not-illustrated heddle frame is moved by the rocking lever 6 into its lower-shed position.

In the position of the individually movable parts of the dobby which is illustrated in FIG. 4, attention must be given to the fact that, due to the connection of the rocking lever 6 through the rail 13 to the differential lever 12, it has a different position than is illustrated for example in FIG. 1. The control mechanism, including reading needle 17, draw hook 14, differential lever 12, plate 11, rail 13 and rocking lever 6, is automatically informed through feedback from the rocking lever 6 of the position of the coupling part 3 with respect to the drive shaft 2, namely, the control of the coupling piece is always correctly independent from its position. The coupling part 3 remains, in the present case, engaged in the groove 20 for the next 180° rotation phase of the drive shaft 2. By lowering the lock 24 into the center notch 22, the rotary switch 8 is locked in its center position for the duration of the next 180° rotation of the drive shaft 2.

Figure 5:
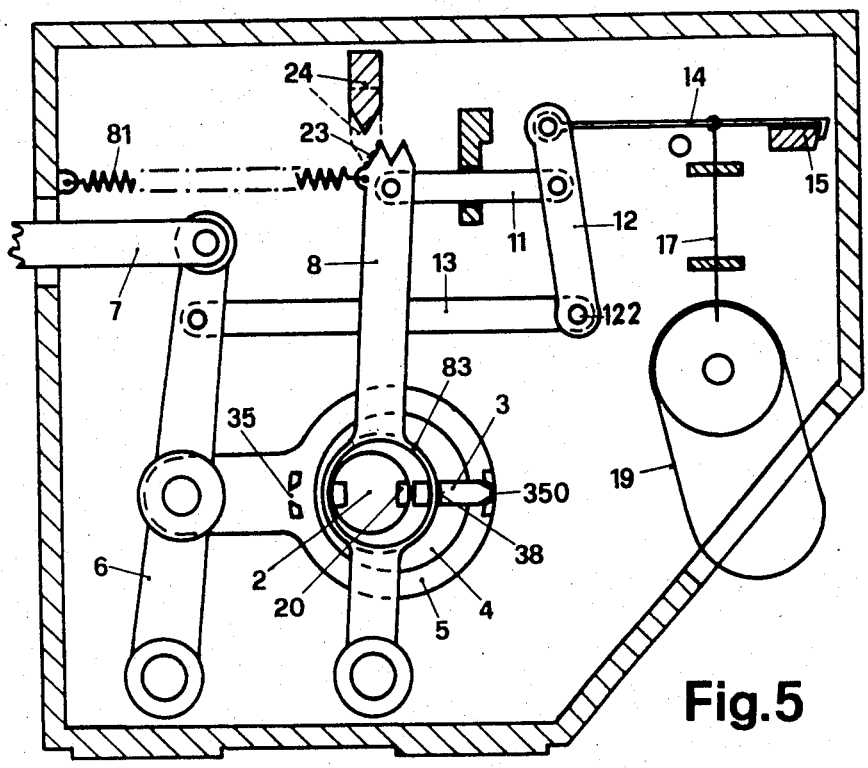
FIG. 5 is a sectional view similar to FIG. 4, but after the movement of the coupling part.

Alternatively, if the pattern card specifies that the heddle frame, starting from the dobby position according to FIG. 3, is to remain in the upper-shed position for the next pick, then the dobby operates according to FIG. 5, where the standstill phase of the drive shaft 2 is again illustrated. The lock 24 is lifted and the reading needle 17 has read one hole of the pattern card 19, so that the draw hook 14 is pulled rightwardly by the draw knife 15, which then causes a pivoting of the differential lever 12 about the joint connection 122 between the differential lever 12 and the rail 13. The differential lever 12 pulls the rotary switch 8 through the plate 11 to the right, and thus through the collar 83 and the sliding groove 38 the coupling part 3 is pulled out of the groove 20 and into the locking groove 350. The drive shaft 2 then rotates 180°. At the same time, the lock 24 is moved into the left notch 23, so that the rotary switch 8 remains locked in its rightmost position. The coupling part 3 is secured against radial movement by the rotary switch 8, which is secured against swinging movement by the lock 24 and notch 23.

A helical expansion or tension spring 81 is provided to urge the upper end of the differential lever 12, prior to the start of the drawing movement of the draw knife 15, toward its leftmost or base position. This spring can be left out if, simultaneously with the drawing movement of the draw knife 15, a not-illustrated push knife moves the draw hook 14 leftwardly when the reading needle 17 reads a nonperforated point on the pattern card 19. The illustrations show how the rotary switch 8 can be moved with the help of a differential lever 12 in three positions, wherein rail 13 and draw hook 14 are the inputs and plate 11 is the output of the differential mechanism.

It is achieved with the described embodiment that the coupling part 3 is constantly guided, both during its standstill, namely in the condition in which it is uncoupled from the drive shaft 2, and during its rotary movement with the drive shaft 2. By holding the rotary switch 8 using the lock 24 during the shaft rotation phase, the restoring spring 81 for the differential lever 12 or the draw hook 14 has no effect on the engagement between the collar 83 and coupling part 3.

Compared with known dobbies, the rotary switch 8 has three positions, determined by an active or passive locking member, for controlling and guiding the coupling part 3, in that in addition to the two common positions produced by the needleworks, a third position is derived from the position of the heddle frame or one of its operating levers.

The control of the coupling part takes place after each 180° rotation of the drive shaft. During the control of the coupling part, the drive shaft stands still for a short engaging and disengaging time. During the rotation phase of the drive shaft, namely during movement of the heddle frames between their upper- and lower-shed positions, the control apparatus reads the position of the heddle frames which is desired for the next pick. The control apparatus maintains the read control position until the start of the next 180° rotation of the drive shaft.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A rotation dobby for controlling a heddle frame of a weaving machine, comprising: a shaft supported for rotation about an axis and having two grooves on diametrically opposite sides thereof; an eccentric member rotatably supported on said shaft; means responsive to rotational movement of said eccentric member about said axis for effecting movement of the heddle frame; a coupling part supported on said eccentric member for substantially radial movement between a radially inner position in which it is operatively engaging one of said grooves in said shaft and a radially outer position in which it is spaced radially outwardly from said shaft; means for holding said coupling part against rotation relative to said eccentric member about said axis; a control member; means for operatively coupling said control member and said coupling part at all times during operation of said dobby so that all movement of said coupling part in each radial direction is effected solely and directly by said control member; and means for effecting movement of said control member according to a predetermined pattern and so as to cause said control member to control the radial position of said coupling part relative to said axis at all times during operation of said dobby; wherein said means for effecting movement of said control member includes holding means for releasably holding said control member, following each control movement of said control member according to said predetermined pattern, in a respective position to which said control member was moved by such control movement and until the start of the next such control movement.

2. A rotation dobby for controlling a heddle frame of a weaving machine, comprising: a shaft supported for rotation about an axis and having two grooves on diametrically opposite sides thereof; an eccentric member rotatably supported on said shaft; means responsive to rotational movement of said eccentric member about said axis for effecting movement of the heddle frame; a coupling part supported on said eccentric member for substantially radial movement between a radially inner position in which it is operatively engaging one of said grooves in said shaft and a radially outer position in which it is spaced radially outwardly from said shaft; means for holding said coupling part against rotation relative to said eccentric member about said axis; a movably supported control member; means for operatively coupling said control member and said coupling part at all times during operation of said dobby; and means for effecting movement of said control member according to a predetermined pattern and so as to cause said control member to control the radial position of said coupling part relative to said axis at all times during operation of said dobby; wherein said means for coupling said control member and coupling part includes said coupling part having a sliding groove therein which extends approximately concentrically to said axis; wherein said control member is a pivotally supported control lever which has an approximately annular control and guide portion which encircles said shaft; wherein said means for coupling said control member and coupling part includes said annular control and guide portion of said control lever having thereon a generally annular, axially projecting collar which slidably engages said sliding groove in said coupling part, wherein said control lever is pivotally movable between angularly spaced first and second positions and a third position therebetween in which said annular collar is substantially concentric to said axis; and wherein said means for effecting movement of said control lever includes holding means which can selectively and releasably hold said control lever in one of said first, second and third positions following each control movement of said control lever according to said predetermined pattern and until the start of the next such control movement.

3. The dobby according to claim 2, wherein said means for effecting movement of said control lever includes a movably supported pattern card having means thereon defining a pattern which corresponds to said predetermined pattern of movement of said control lever, reading means for sensing said pattern on said pattern card, and means responsive to said reading means and to the position of the heddle frame for causing said holding means to temporarily release said conrol lever, for positioning said control lever in a selected one of said first, second and third positions, and for thereafter reactuating said holding means.

4. The dobby according to claim 3, wherein said means for positioning said control lever includes a differential lever having spaced first and second hinge points and a third hinge point therebetween, said first hinge point being pivotally coupled to a first element which is a part of said reading means, said third hinge point being pivotally coupled to a second element which is operatively connected to said control lever, and said second hinge point being pivotally coupled to a third element which is operatively connected to said means for effecting movement of the heddle frame and which is moved thereby in synchronism with the heddle frame.

5. The dobby according to claim 4, wherein said first element is a draw hook, wherein said first hinge point of said differential lever is pivotally connected to said draw hook, wherein said second element is a plate which is pivotally coupled to said control lever at a location spaced radially from the pivot axis of said control lever, wherein said means for effecting movement of the heddle frame includes a pivotally supported rocking lever, wherein said third element is a rail which is pivotally coupled to said rocking lever, and wherein said means for positioning said control lever includes resilient means for yieldably urging said differential lever toward a stop in a direction which corresponds to movement of said first hinge point in a direction opposite a direction of operational drawing movement of said draw hook.

6. The dobby according to claim 5, wherein said means for effecting movement of the heddle frame includes a connecting rod which is rotationally supported on said eccentric member, which is movable in a direction radially of said axis of rotation of said shaft and which is pivotally connected to said rocking lever, said direction of movement of said connecting rod being approximately parallel to said direction of operational drawing movement of said draw hook, wherein said second and third elements each extend approximately parallel to said direction of movement of said connecting rod, wherein said rocking lever, said control lever and said differential lever each extend approximately parallel to each other and generally transversely of said direction of movement of said connecting rod, said annular control and guide portion of said control lever moving between said first and second positions thereof in directions approximately parallel to said direction of movement of said connecting rod, and wherein said resilient means includes an expansion spring having one end connected to a housing of said dobby and having its other end connected to an end of said control lever remote from the pivot axis thereof.

7. The dobby according to claim 2, wherein said holding means includes a lock member movable in synchronism with rotation of said drive shaft between a position spaced from and a position engaging a free end of said control lever.

8. The dobby according to claim 7, wherein said free end of said control lever has two projections, said lock member being received in a space between said projections when said holding means is releasably holding said control lever in said third position.

* * * * *